US007572991B2

(12) United States Patent
Du et al.

(10) Patent No.: US 7,572,991 B2
(45) Date of Patent: Aug. 11, 2009

(54) KNOB ASSEMBLY

(75) Inventors: Yu-Jen Du, Taipei (TW); Yu-Jeng Yang, Taipei (TW)

(73) Assignee: Inventec Corporation, Taipei (TW)

( * ) Notice: Subject to any disclaimer, the term of this patent is extended or adjusted under 35 U.S.C. 154(b) by 310 days.

(21) Appl. No.: 11/710,519

(22) Filed: Feb. 26, 2007

(65) Prior Publication Data

US 2008/0202902 A1 Aug. 28, 2008

(51) Int. Cl.
*H01H 19/14* (2006.01)

(52) U.S. Cl. ..... 200/14; 200/339

(58) Field of Classification Search ..... 200/5 R, 200/5 E, 13, 14, 11 R, 11 TW, 329–331, 200/339, 336, 341
See application file for complete search history.

(56) References Cited

U.S. PATENT DOCUMENTS 5,711,415 A * 1/1998 Fukuda et al. ..... 200/570
6,396,419 B1 5/2002 Yeh
6,642,459 B2 * 11/2003 Chou et al. ..... 200/11 TW
6,680,444 B1 * 1/2004 Lee ..... 200/4
6,849,817 B2 * 2/2005 Takata et al. ..... 200/339
6,943,305 B2 * 9/2005 Kawamura et al. ..... 200/4

* cited by examiner

*Primary Examiner*—Renee S Luebke
*Assistant Examiner*—Marina Fishman
(74) *Attorney, Agent, or Firm*—Muncy, Geissler, Olds & Lowe, PLLC

(57) ABSTRACT

A knob assembly applicable for an electronic device for executing a plurality of default commands is provided, which at least includes a manipulator and a plurality of push switches disposed adjacent to the manipulator, wherein the manipulator performs back and forth swing and linear movement, and touches a corresponding push switch in the travel of the back and forth swing and the linear movement, so as to output a trigger signal for executing a corresponding default command.

5 Claims, 9 Drawing Sheets

KNOB ASSEMBLY

BACKGROUND OF THE INVENTION

1. Field of Invention

The present invention relates to a signal manipulator, and more particularly, to a knob assembly for controlling signal output through rotational or linear movement.

2. Related Art

A human-computer interface serves as a communication interface between an electronic product and a user, and the user instructs the electronic product to execute corresponding default commands through manipulating the human-computer interface. Portable electronic devices such as notebook computers, PDAs, or mobile phones, have various kinds of human-computer interfaces in various shapes, for example, mechanical pressing keys or touch buttons. The user can make a command of "Select", "Execute", or "Terminate", through pressing or touching the human-computer interfaces, such that the portable electronic device performs corresponding actions according to the user's command.

As for the human-computer interface, with reference to US Patent Publication U.S. Pat. No. 6,396,419 (hereinafter Case 419 for short), it discloses a digital volume control knob for a laptop computer, and mentions that, a conventional laptop computer uses an audiovisual software, a variable resistor, or a hot key to control the volume. However, the aforementioned methods have the disadvantage that it is difficult to control, or it is easy to cause malfunction, and thus Case 419 discloses a digital volume control knob using a variable resistor as the switch to control the volume.

As shown in FIG. 1, the digital volume control knob includes a primary control device 14 and a secondary control device 16, wherein the primary control device 14 further includes a control panel 141 and a blade spring, and the secondary control device 16 further includes a plurality of chips 162. The control panel 141 is operated by the user to rotate or move linearly, and when the user operates the control panel 141, the blade spring is made to touch the chips 162 in different positions. That is, each corresponding default signal (such as a signal for controlling the volume) may be outputted, so as to play a corresponding large or small sound or be mute.

In the volume control knob disclosed in Case 419, the chip 162 disposed on the secondary control device 16 is a conductive metal sheet that forms a contacting region, such that the blade spring of the control panel 141 contacts and then electrically communicates with the conductive metal sheet to output the default signals. When the blade spring of the control panel 141 is still in the contacting region, the signals are continuously outputted (for example, the volume continuously becomes larger or smaller). When another pressure is applied to force the blade spring of the control panel 141 to release from the contacting region of the chip 162, the signal is switched off.

Case 419 solves the problems of the software control, the variable resistor control, or the hot key control. However, the chip 162 forming the electrical connection is a contacting region, and thus, when the signal is switched off and an external force is applied to the control panel 141, a time difference still exists from applying the external force to releasing the blade spring from the contacting area of the chip 162. That is, the user has adjusted to the desired volume and then released the control panel 141, and at this time, the blade spring is still not released from the chip 162 yet. As such, a difference occurs between the expected value of the user and the actual value.

SUMMARY OF THE INVENTION

In view of the aforementioned prior art, the volume control knob outputs a default signal through the contact between the blade spring and the chip, but the corresponding volume change cannot be shown accurately. Therefore, in view of the aforementioned problems, the present invention is directed to providing a knob assembly, which accurately controls signal output.

The knob assembly of the present invention is applicable for an electronic device, which comprises a manipulator, an elastic member, and a plurality of push switches. The manipulator is pivoted to the electronic device, and it is in an initial position at a normal state, moves towards a first movement direction and a second movement direction under an external force, and towards a third movement direction along which the manipulator is pushed to move linearly. Additionally, the plurality of push switches are disposed adjacent to the manipulator corresponding to the first, second, and third movement directions respectively, such that the manipulator is selectively rotated in the first movement direction and the second movement direction, or pushed to move linearly in the third movement direction. When the manipulator touches each of the push switches, a control signal is output, and the outputted signal is interrupted when the elastic member is released from each of the push switches.

The efficacy of the knob assembly of the present invention lies in that, the push switches are disposed on the manipulator in each movement direction, such that the manipulator correctly touches a corresponding press switch without touching others. Therefore, not only incorrect signal outputs are reduced, but the signal output accuracy is also enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

The knob assembly provided by the present invention is applicable for an electronic device, such as notebook computers, desktop computers, DVD players, and mobile phones, but it is not limited to be applied in the aforementioned electronic devices. Furthermore, the knob assembly may be used to activate control commands of "Forward", "Backward", "Zoom in", "Zoom out", "Select", "Play", "Stop", "Volume up", "Volume down", and "Mute", but it is not limited to this. In the following specific embodiments of the present invention, the knob assembly is applied in a notebook computer to control the volume.

Figure 1:
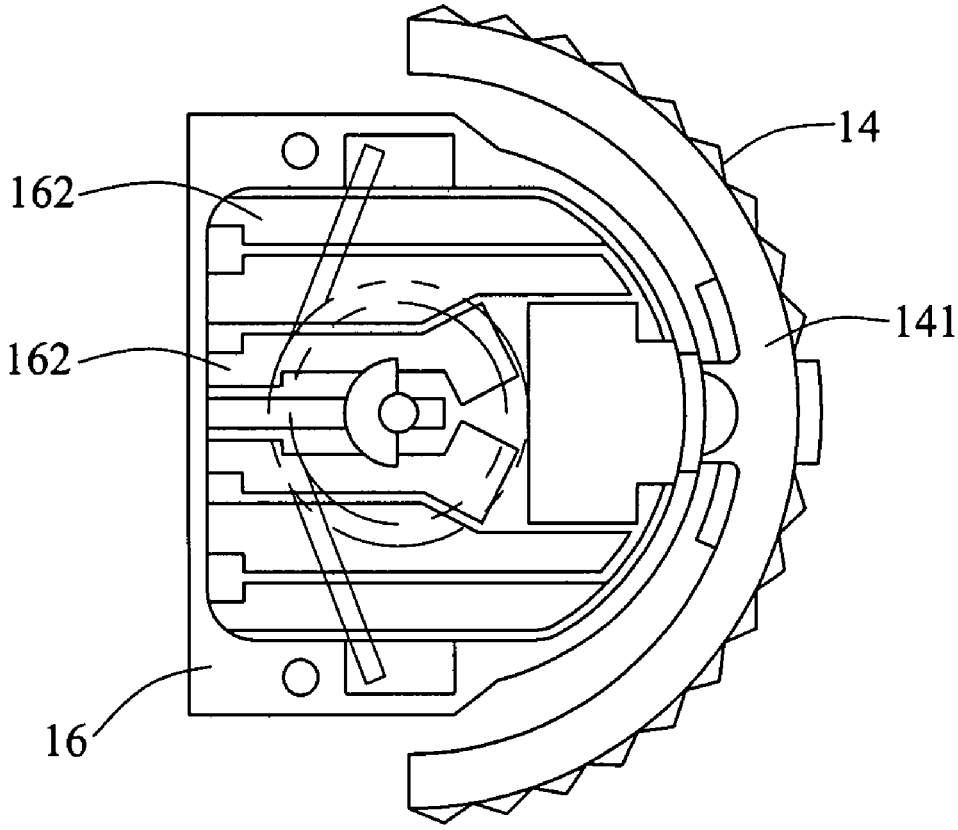
FIG. 1 (Conventional art)
FIG. 1 is a planar structural view of a volume control knob of the prior art.
Figure 2:
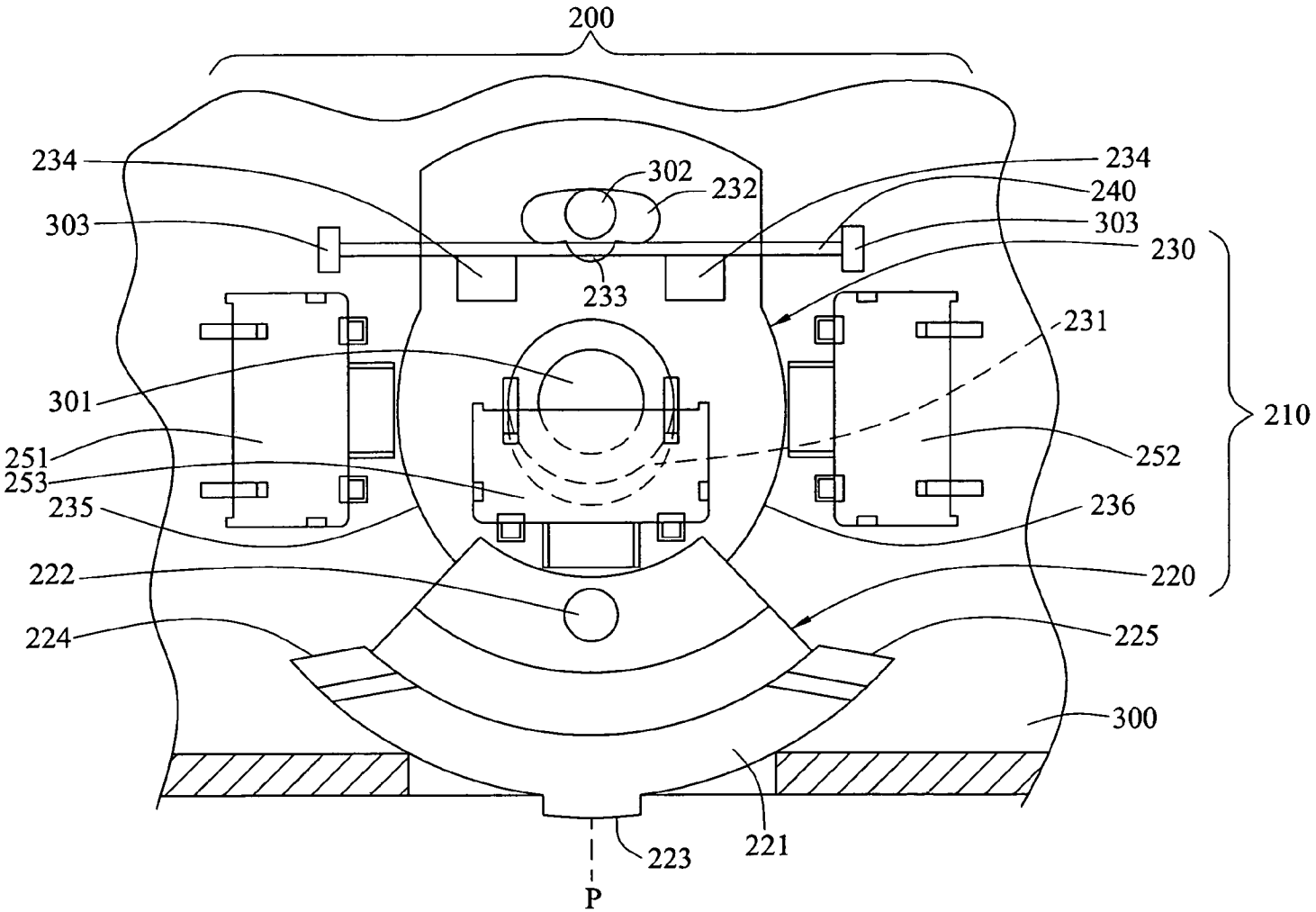
FIG. 2 is a schematic structural view of a manipulator of the present invention.

Referring to FIG. 2, it is a planar structural view of a knob assembly according to a first embodiment of the present invention. The knob assembly 200 is applied in a notebook computer 300, and an external force is applied to control the audio, and thus upon receiving a trigger signal, the notebook computer 300 executes a corresponding default command.

Figure 3:
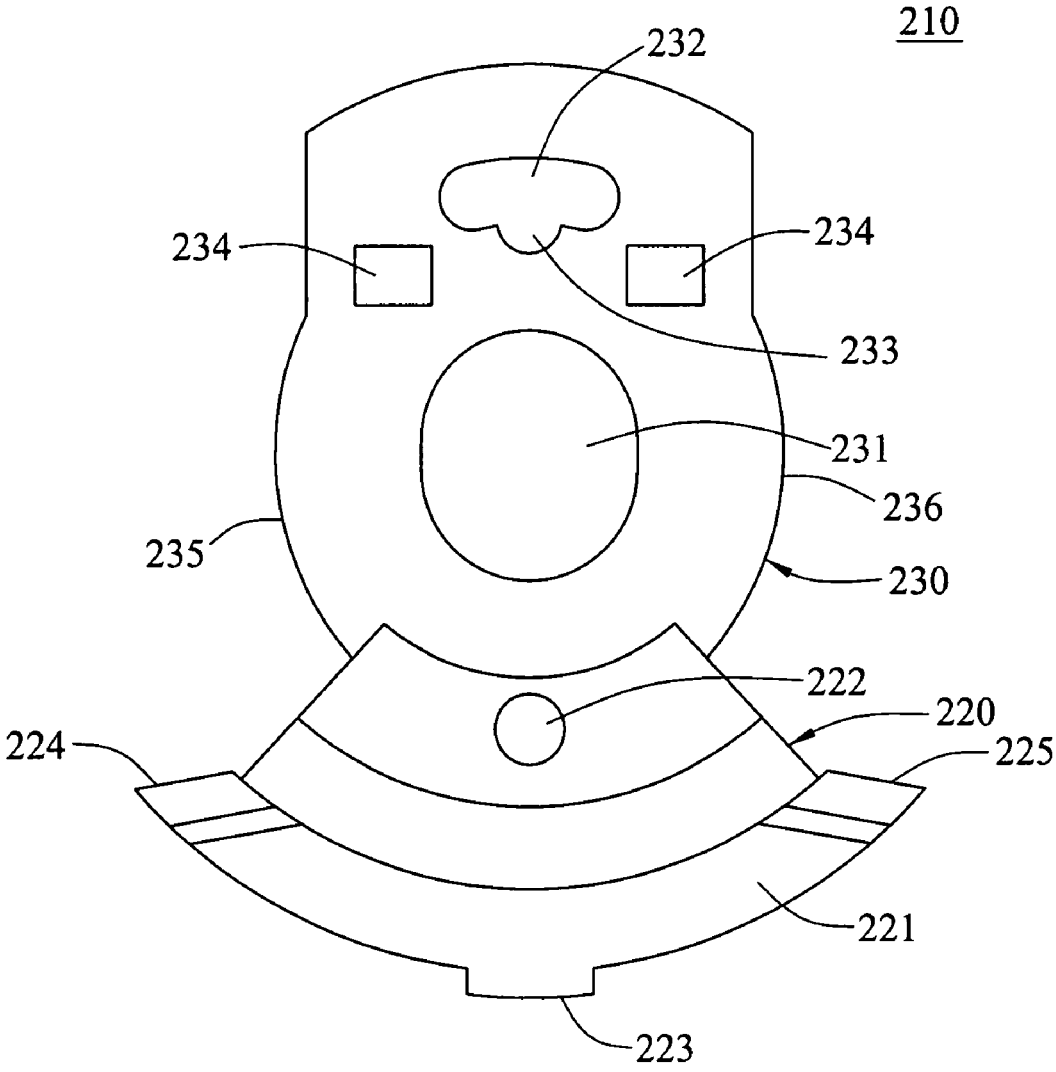
FIG. 3 is a planar structural view of a first embodiment of the present invention.
Figure 4A:
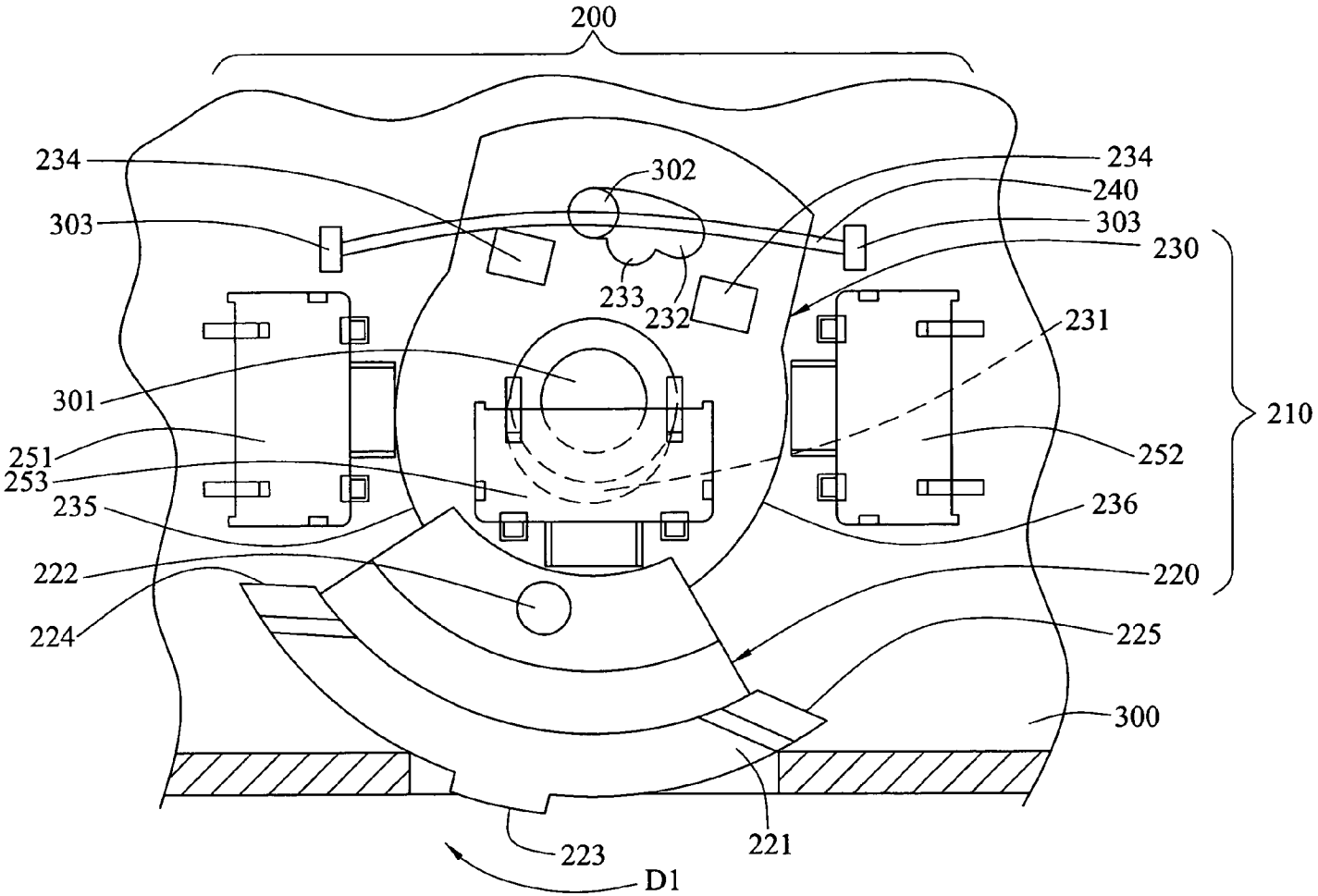
FIG. 4A is a usage state diagram of the first embodiment of the present invention.
Figure 4B:
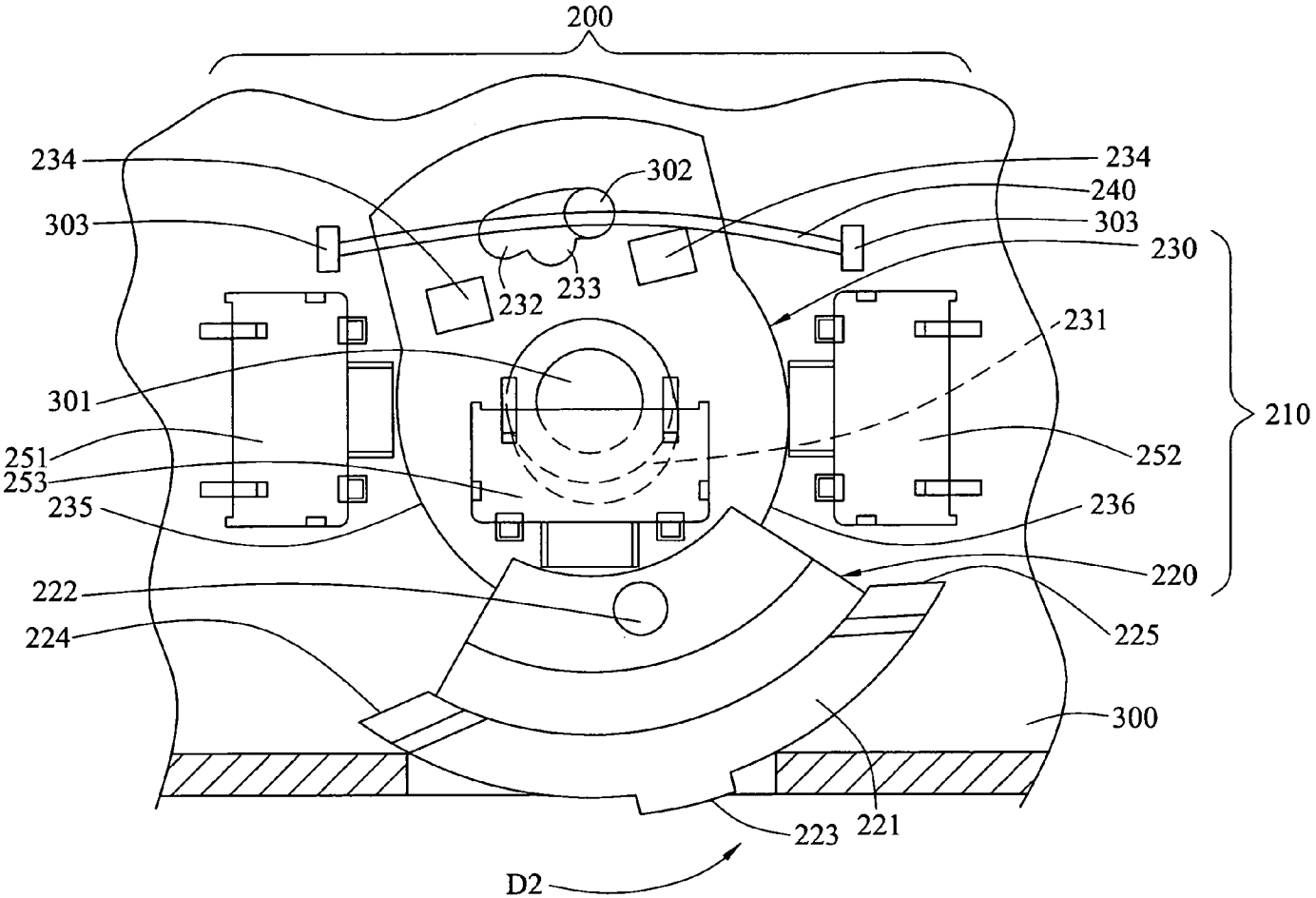
FIG. 4B is another usage state diagram of the first embodiment of the present invention.
Figure 4C:
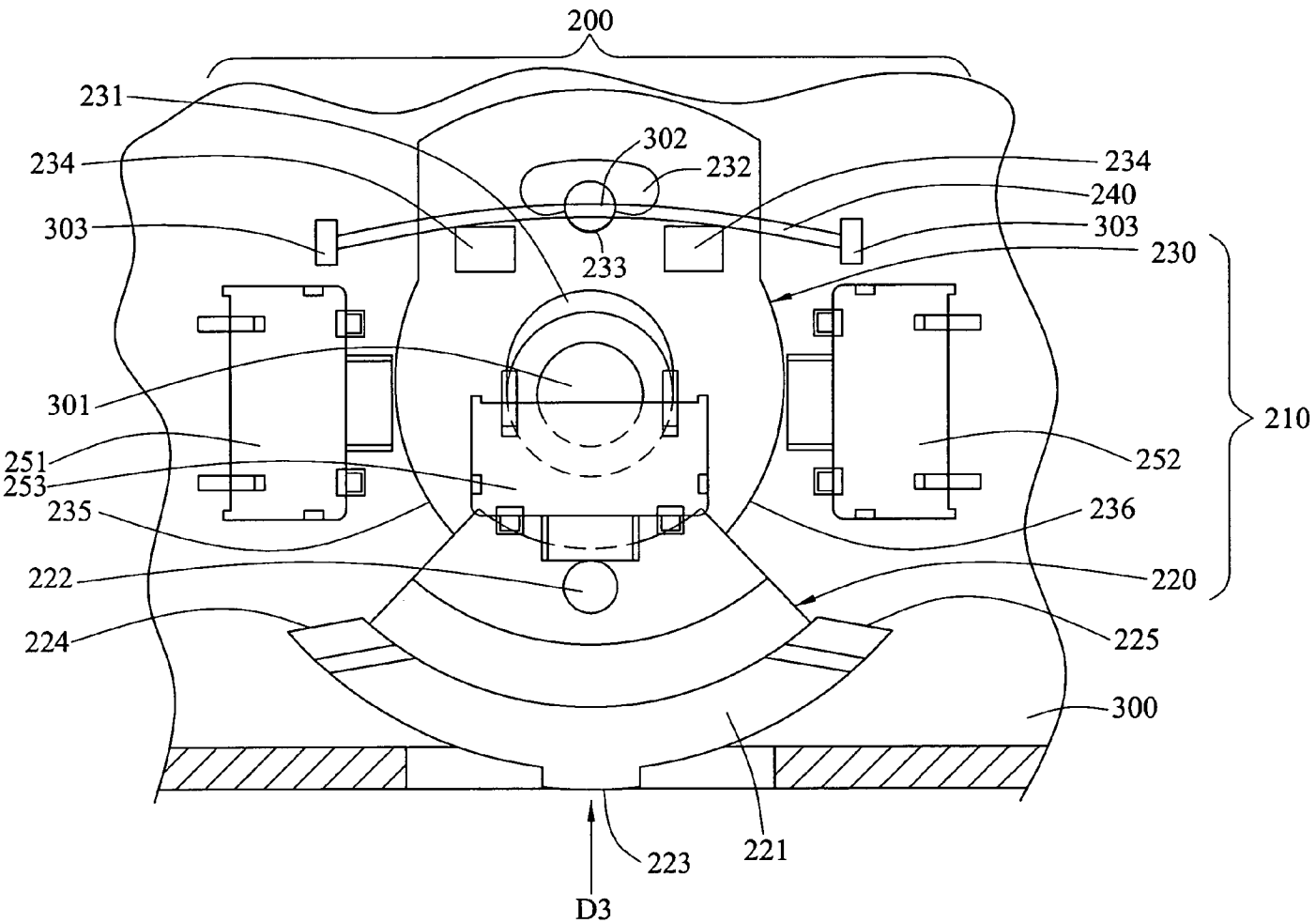
FIG. 4C is still another usage state diagram of the first embodiment of the present invention.

Referring to FIGS. 2 and 3, the knob assembly 200 includes a manipulator 210, an elastic member 240, and a plurality of push switches, wherein the manipulator 210 is an elastic-plastic object in response to the action state of the accommodation space and the practical application. The manipulator 210 includes a control unit 220 and a rotation unit 230. Furthermore, the control unit 220 provides a force exertion portion that can be manually operated, and has a control panel 221 and a bearing portion 222 disposed in the normal direction of the control panel 221. For sake of the convenience in applying forces, a protruded push bump 223 is further disposed on the control panel 221, so as to generate a frictional force on one side of the control panel 221.

The rotation unit 230 and the control unit 220 are integrated into one piece, and they move along a direction in which the control unit 220 is applied by a force. The rotation unit 230 has an elliptical chute 231 and a guide slot 232 adjacent to the chute 231. Besides two opposite ends, the guide slot 232 further has a stopping hole 233 extending from an edge of the slot. Furthermore, the rotation unit 230 further has protrusions 234 in the normal direction, which are adjacent to the guide slot 232.

Referring to FIGS. 2 and 3, when the manipulator 210 and other elements constitute the knob assembly 200, the manipulator 210 is pivoted to the notebook computer 300 through the rotation unit 230 and the control panel 221 is protruded from the notebook computer 300. The notebook computer 300 further has a fixed shaft 301 extruding into the chute 231 and a fixed rod 302 extruding into the guide slot 232 at the pivoting positions. Since the chute 231 is elliptical, the chute 231 is not only pivoted to the fixed shaft 301, but the fixed shaft 301 also slides in the elliptical chute, and thus when the manipulator 210 is pressed, the manipulator 210 is moved in a straight line.

In a similar way, the guide slot 232 has two opposite ends and a stopping hole 233, and the guide slot 232 is not fixedly pivoted to the fixed rod 302, but when the manipulator 210 is rotated or pressed, the manipulator 210 is moved along a direction where a force is applied. As such, under an external force, the manipulator 210 may be successfully rotated or moved linearly relative to the notebook computer 300. The manipulator 210 is in an initial position P at a normal state, and when rotating and swinging under an external force, the manipulator 210 has, for example, a first movement direction D1 and a second movement direction D2, and it is moved in the first movement direction D1 and the second movement direction D2. Additionally, upon being pressed to move linearly, the manipulator 210 is moved in a third movement direction D3.

The elastic member 240 bears against the manipulator 210, and penetrates the protrusions 234, and two ends of the elastic member 240 are respectively disposed on the supports 303 of the notebook computer 300, wherein the elastic member 240 is a plate spring or another recovery component. The elastic member 240 provides a tensile force for the manipulator 210, and thus, after the manipulator 210 is moved under an external force, it can return to the initial position P under the recovery force of the elastic member 240. Furthermore, the plurality of push switches includes a first push switch 251, a second push switch 252, and a third push switch 253, which are adjacently disposed on the manipulator 210 corresponding to the first movement direction D1, the second movement direction D2, and the third movement direction D3 respectively, so as to make the manipulator 210 selectively move in the first movement direction D1, the second movement direction D2, and the third movement direction D3, and touch the first push switch 251, the second push switch 252, and the third push switch 253 respectively. As such, a default control signal is outputted through the manipulator 210. In addition, when the manipulator 210 is released from each push switch and does not touch it any longer, the output of the trigger signal is interrupted.

Referring to FIGS. 4A, 4B, and 4C, and FIG. 2, when the knob assembly 200 is put into practical application, the manipulator 210 is operated through the control panel 221 protruded from the notebook computer 300. When the manipulator 210 is moved in the first movement direction D1, the control panel 221 is rotated accordingly, and the manipulator 210 is synchronously rotated. At this time, the chute 231 is also rotated relative to the fixed shaft 301 till one end of the guide slot 232 bears against the fixed rod 302. When the manipulator 210 stops moving, under the influence of the rotation of the manipulator 210, the elastic member 240 causes a relative displacement change between the protrusions 234 and the supports 303. When being supported and deformed, the elastic member 240 accumulates the recovery force, so as to recover the manipulator 210 to the original initial position P.

Meanwhile, a contact surface 235 of the rotation unit 230 touches the first push switch 251 corresponding to the first movement direction D1, wherein the contact surface 235 is arc-shaped to reduce the contact area and thereby being touched more concentratedly. At this time, the first push switch 251 further transmits information to the notebook computer 300, thereby controlling the output volume of the notebook computer 300. On the contrary, when the external force applied to the control panel 221 is removed, the elastic member 240 does not need to contradict with the external force, but exerts a recovery force on the manipulator 210, such that the manipulator 210 is returned to the initial position P to continue the subsequent operation.

According to the aforementioned operations, when the control panel 221 is rotated in the second movement direction D2 and the manipulator 210 is rotated synchronously, the chute 231 is also rotated relative to the fixed shaft 301. The manipulator 210 stops moving, when the other end of the guide slot 232 bears against the fixed rod 302. At this time, the elastic member 240 is supported by the protrusions 234 and deformed, thereby recovering the manipulator 210 to the original initial position P.

Meanwhile, a contact surface 236 of the rotation unit 230 touches the second push switch 252 corresponding to the second movement direction D2. Therefore, the output volume of the notebook computer 300 is controlled by the information transmitted through the second push switch 252. The first push switch 251 and the second push switch 252 are disposed in the track of the rotation of the manipulator 210, and respectively used for controlling the volume. Therefore, during the operation, if the output volume needs to be selected more accurately, the first push switch 251 and the second push switch 252 are respectively touched in the first movement direction D1 and the second movement direction D2, so as to fine adjust the output volume, and thereby making the output volume be more accurate.

Additionally, if the control panel 221 is pressed to move along the third movement direction D3 to synchronously drive the manipulator 210, the manipulator 210 does not stop moving, until one end of the chute 231 bears against the fixed shaft 301 and the stopping hole 233 also bears against the fixed rod 302. The elastic member 240 is supported by the projections 234 and accumulates the recovery force, so as to recover the manipulator 210 to the original initial position P. At this time, the bearing portion 222 directly touches the third push switch 253 corresponding to the third movement direction D3. On the contrary, when the external force applied to the control panel 221 is removed, the elastic member 240 exerts the recovery force on the manipulator 210, so as to recover the manipulator 210 to the initial position P.

The position of the third push switch 253 is different from that of the first push switch 251 and the second push switch 252 corresponding to the movement track of the manipulator 210, and provides another functional option in controlling the output volume. For example, the first push switch 251 and the second push switch 252 are used to control the output volume, and the third push switch 253 is used to control the mute function, so as to satisfy the user's different requirements.

Figure 5:
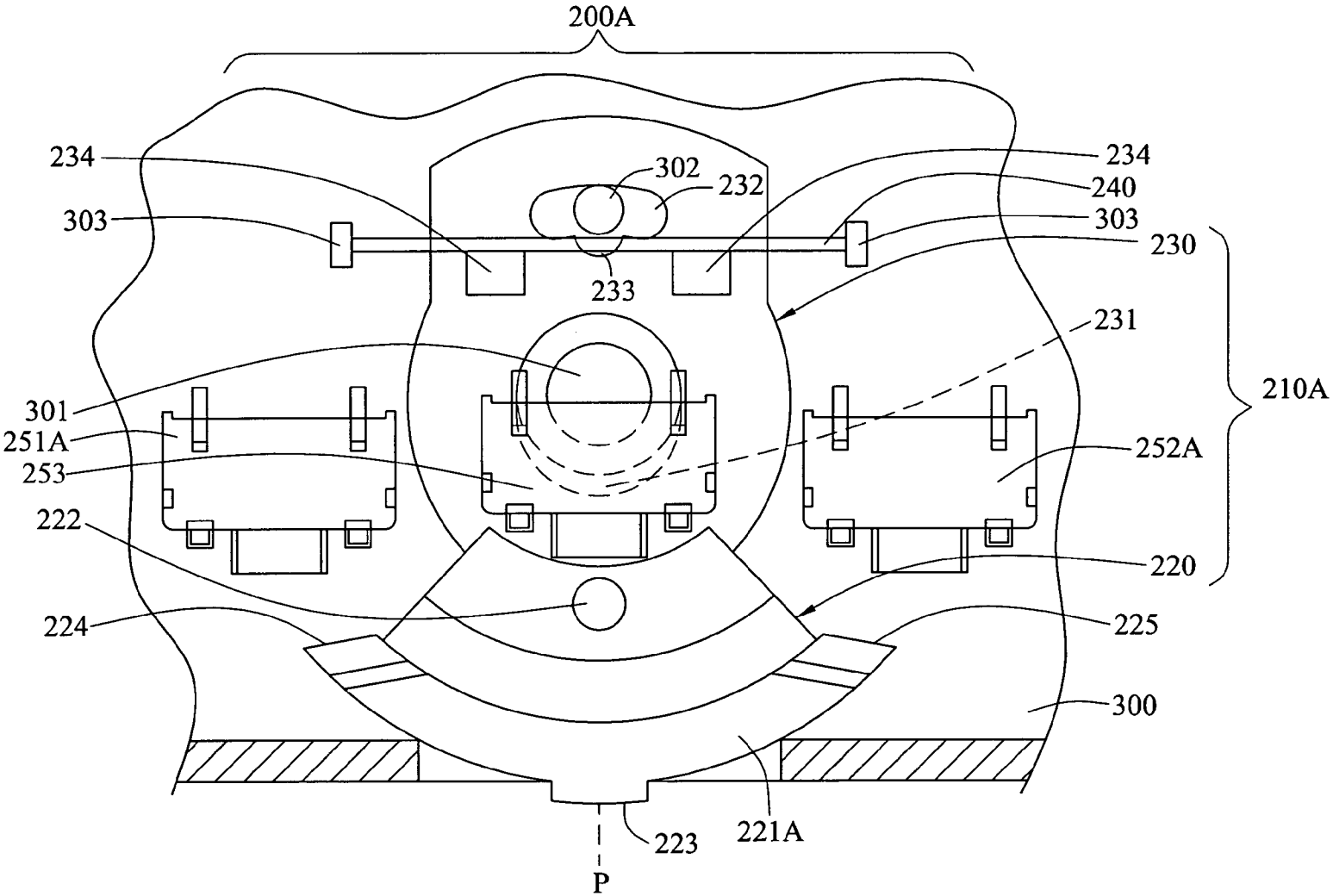
FIG. 5 is a planar structural view of a second embodiment of the present invention.
Figure 6A:
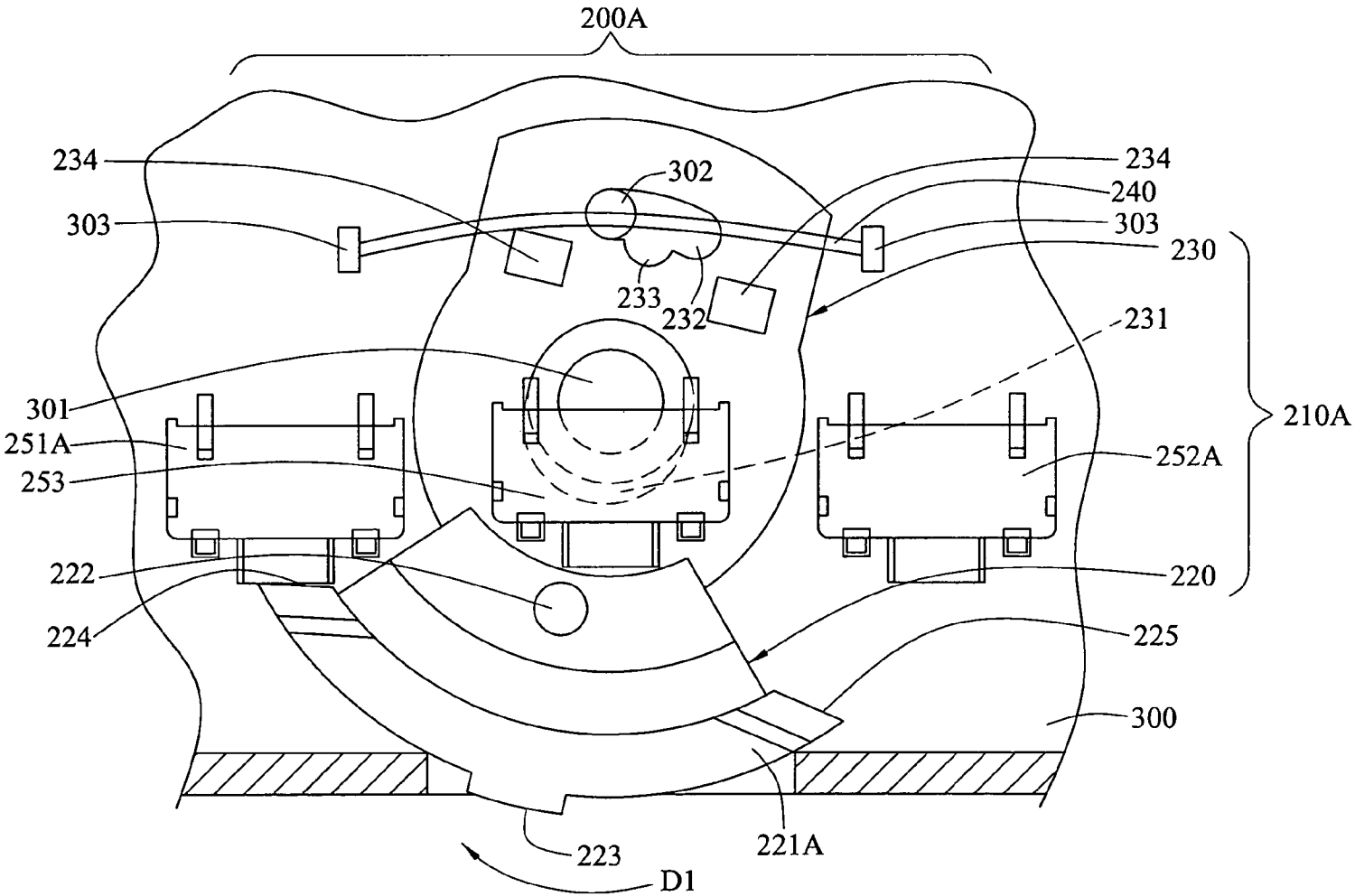
FIG. 6A is a usage state diagram of the second embodiment of the present invention.
Figure 6B:
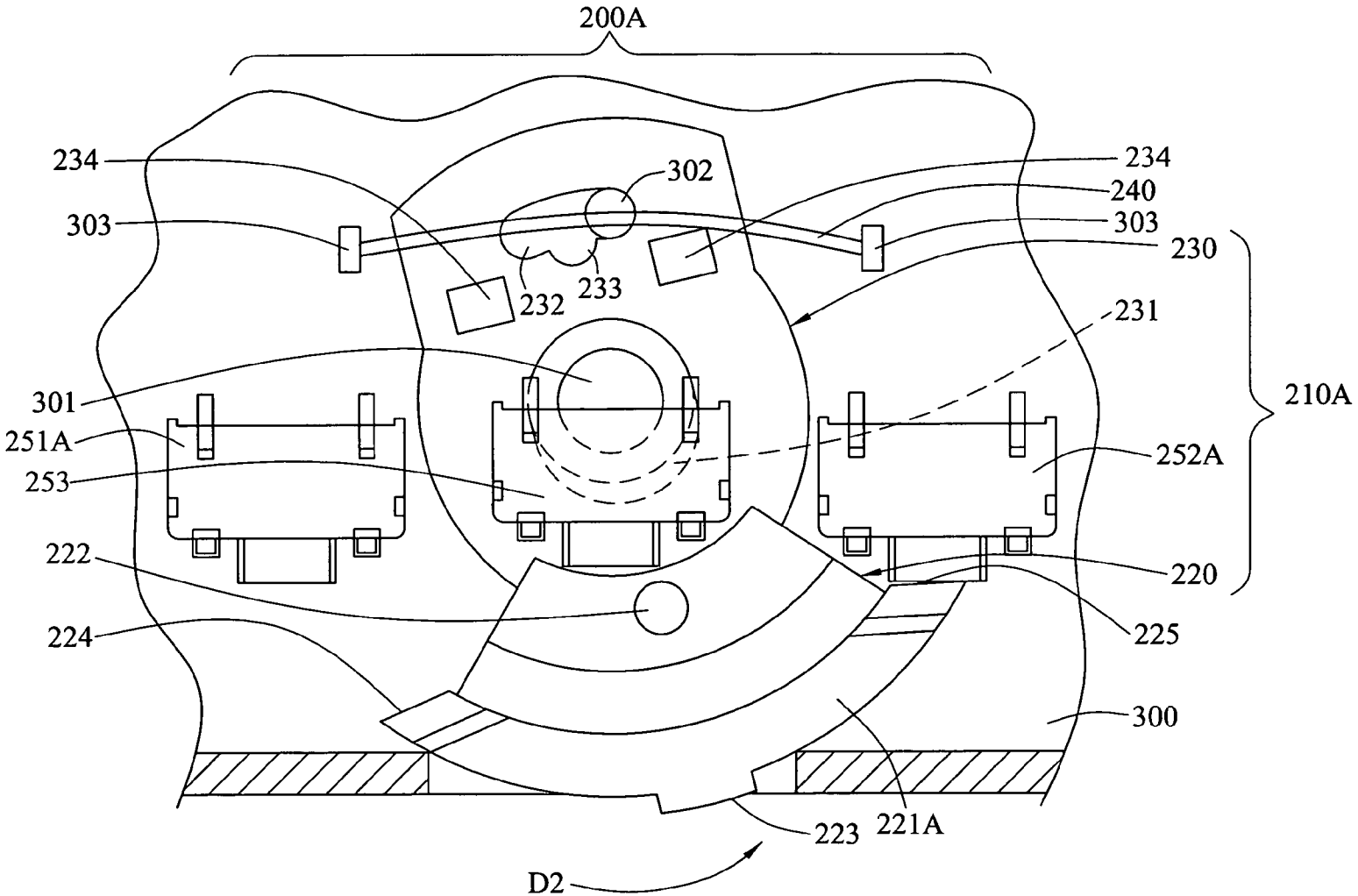
FIG. 6B is another usage state diagram of the second embodiment of the present invention.

Referring to FIGS. 5, 6A, and 6B, FIG. 5 is a planar structural view of a second embodiment of the present invention. The structure of the knob assembly 200A is substantially the same as that in the first embodiment, with the difference lying in that, the knob assembly 200A touches the first push switch 251A, the second push switch 252A, and the third push switch 253A in different positions. In FIG. 5, when the control panel 221A is selected to be rotated in the first movement direction D1 or the second movement direction D2 and the manipulator 210A is synchronously rotated, the control panel 221A respectively touches the first push switch 251A and the second push switch 252A through end faces 224 and 225.

In this embodiment of the present invention, each of the push switches is disposed in a corresponding movement direction, and a stopping mechanism is further provided, such that the manipulator correctly touches each of the push switches in the correct position, so as to transmit signals accurately. Furthermore, the output volume is fine adjusted through rotation and swing, so as to more easily control the required output volume.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A knob assembly, which executes a plurality of default commands, comprising:

a manipulator, rotatably pivoted and linearly displaced to the electronic device, wherein the manipulator is in an initial position at a normal state and at least has a first movement direction and a second movement direction along which the manipulator is rotated to swing back and forth, and a third movement direction along which the manipulator is pressed to move linearly, wherein the manipulator comprises:

a control unit, having a control panel and a bearing portion in normal direction of the control panel; and a rotation unit, integrated with the control unit into one piece and pivoted to the electronic device, wherein the rotation unit has a chute and a guide slot adjacent to the chute in a pivoting position, the guide slot has a stopping hole in the third movement direction; and the electronic device further has a fixed shaft extruding into the chute and a fixed rod extruding into the guide slot;

an elastic member, bearing against the manipulator and keeping the manipulator in the initial position; and a plurality of push switches, disposed adjacent to the manipulator corresponding to the first movement direction, the second movement direction, and the third movement direction, such that the manipulator selectively moves towards the first movement direction, the second movement direction, and the third movement direction, wherein if the manipulator touches the corresponding push switch, a trigger signal is output; if the manipulator is released from the push switch, the trigger signal is switched off.

2. The knob assembly as claimed in claim 1, wherein a push bump is further protruded and disposed on the control panel for manipulation convenience.

3. The knob assembly as claimed in claim 1, wherein a protrusion is further disposed on the rotation unit in normal direction, and the elastic member penetrates the protrusion and has two ends disposed on the electronic device respectively.

4. The knob assembly as claimed in claim 1, wherein the rotation unit further comprises two contact surfaces, and when the manipulator is rotated in the first movement direction and the second movement direction, the manipulator touches each corresponding push switch through each of the contact surfaces.

5. The knob assembly as claimed in claim 1, wherein when the manipulator moves in the third movement direction, the manipulator directly touches the corresponding push switch through the bearing portion.

* * * * *